US008824920B2

(12) United States Patent
Eto

(10) Patent No.: US 8,824,920 B2
(45) Date of Patent: Sep. 2, 2014

(54) UNIT MOUNT-DEMOUNT MECHANISM AND IMAGE FORMING APPARATUS INCLUDING THE SAME

(75) Inventor: Daisuke Eto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 174 days.

(21) Appl. No.: 13/454,175

(22) Filed: Apr. 24, 2012

(65) Prior Publication Data

US 2012/0275820 A1 Nov. 1, 2012

(30) Foreign Application Priority Data

Apr. 27, 2011 (JP) ..... 2011-099036

(51) Int. Cl.
*G03G 15/00* (2006.01)
*G03G 21/18* (2006.01)

(52) U.S. Cl.
CPC ..... *G03G 21/1842* (2013.01)
USPC ..... 399/110

(58) Field of Classification Search
CPC ..... G03G 15/0875
USPC ..... 399/110
See application file for complete search history.

(56) References Cited

U.S. PATENT DOCUMENTS 5,937,240 A 8/1999 Kanno et al.
8,660,454 B2 * 2/2014 Lee et al. ..... 399/90
2003/0049046 A1 3/2003 Okabe
2006/0091769 A1 * 5/2006 Dubon ..... 312/333
2007/0201900 A1 8/2007 Murayama

FOREIGN PATENT DOCUMENTS

JP 08-016069 A 1/1996
JP 2003-066718 3/2003
JP 2007-034335 A 2/2007
JP 2007-232933 A 9/2007
JP 2009-157389 A 7/2009

OTHER PUBLICATIONS

Machine translation of Tetsuo, JP 2007-034335 A, publication date: Feb. 8, 2007.*

* cited by examiner

*Primary Examiner* — Walter L Lindsay, Jr.
*Assistant Examiner* — Frederick Wenderoth
(74) *Attorney, Agent, or Firm* — Morgan, Lewis & Bockius LLP

(57) ABSTRACT

A mount-demount mechanism includes a unit that is mountable on and demountable from an apparatus main body, and a pair of slide rails that are disposed on the apparatus main body and slidably support both surfaces parallel to a mount-demount direction of the unit. Provided, on both side surfaces thereof parallel to a mount-demount direction of the unit, are a pair of unit-side rollers that include a first roller that is disposed in a downstream insertion direction and a second roller that is disposed in an upstream insertion direction. The slide rail is provided with a rail groove that includes a lower rail and an upper rail, a cut-away portion for allowing the unit-side roller run off from the rail groove is formed on a portion of the upper rail or the lower rail, wherein either of the first roller and the second roller runs off from the rail groove.

8 Claims, 14 Drawing Sheets

UNIT MOUNT-DEMOUNT MECHANISM AND IMAGE FORMING APPARATUS INCLUDING THE SAME

INCORPORATION BY REFERENCE

This application is based on Japanese Patent Application No. 2011-99036 filed on Apr. 27, 2011, the contents of which are hereby incorporated by reference.

BACKGROUND

The present disclosure relates to a mount-demount mechanism for a unit that is mountable on and demountable from a main body of an image forming apparatus, and to an image forming apparatus that includes the mount-demount mechanism.

Conventionally, in an image forming apparatus that uses an electro-photographic process, a fix unit, a drum unit, a development unit, an intermediate transfer unit and the like are fixed to predetermined positions in the image forming apparatus by means of screws. On the other hand, it is necessary to demount these units from a main body of the image forming apparatus for a paper-sheet jam resolving time. Besides, in a case where the service life of the units is shorter than the life of the apparatus main body, it is necessary to replace periodically the units.

In the above conventional structure, at a unit replacement time or a paper-sheet jam resolving time, it is necessary to contact a service person, which is inefficient. On the other hand, it is a large burden on a general user to perform a mount-demount work of a unit by means of tools such as a screw driver and the like. Accordingly, a method, which allows a user to easily perform the unit replacement work, is proposed and a structure is widely used, in which a unit is inserted or drawn out along a guide shape that is disposed in the image forming apparatus main body.

For example, a mount-demount mechanism for a development device is known, in which a guide member is disposed between two rollers situated on a rail surface of the apparatus main body, and an inclination of a development device is confined in a predetermined range during mount-demount times of the development device, whereby a photoreceptor is not damaged by members such as a development roll and the like.

Besides, an image forming apparatus is known, which includes a pair of first inclination guide portions that have a downward inclination for guiding a guide shaft of a unit that includes a photoreceptor, and a second inclination guide portion that is disposed between the pair of first inclination guide portions and has a downward inclination in the same direction as the first inclination guide portion to guide a bottom surface of the unit, wherein when the unit comes to an insertion stop position, a rear portion of the unit is rotated downward, whereby the unit is able to be housed and fixed in a housing portion.

As described above, in the structure in which the unit is inserted into and drawn out from the image forming apparatus main body, because of a request for compactness of the device and a restriction on a layout and the like, there is a case where other units and components are present in insertion and drawing out routes of the unit.

In such a case, it becomes necessary to perform the insertion and drawing out operations of the target unit avoiding the other units and components, so that the locus of the insertion and drawing out routes does not become straight and becomes complicated. Besides, the insertion and drawing out operations of the unit become onerous. Further, there is a problem that positioning accuracy of the unit in the image forming apparatus main body becomes low, a defective mesh between gears and an image trouble become likely to occur.

SUMMARY

In light of the above problems, it is an object of the present disclosure to provide a unit mount-demount mechanism that is able to easily mount and demount a unit on and from an image forming apparatus main body and also improves a positioning accuracy of the unit in the image forming apparatus main body, and an image forming apparatus that includes the unit mount-demount mechanism.

To achieve the above object, a mount-demount mechanism for a unit according to one aspect of the present disclosure includes a unit that is mountable on and demountable from a device main body, and a pair of slide rails that are disposed on the device main body and slidably support both surfaces parallel to a mount-demount direction of the unit, and is provided, on both side surfaces thereof parallel to a mount-demount direction of the unit, with a pair of unit-side rollers which include a first roller that is disposed in a downstream in a unit insertion direction and a second roller that is disposed in an upstream in the unit insertion direction, the slide rail is provided with a rail groove that includes a lower rail and an upper rail with which the unit-side roller engages, a cut-away portion for allowing the unit-side roller run off from the rail groove is formed on a portion of the upper rail or the lower rail, wherein either of the first roller and the second roller runs off from the rail groove, whereby the unit is placed in a predetermined position in the apparatus main body.

Still other objects of the present disclosure and specific advantages obtained by the present disclosure will become more apparent from the following description of preferred embodiments.

DETAILED DESCRIPTION

Figure 1:
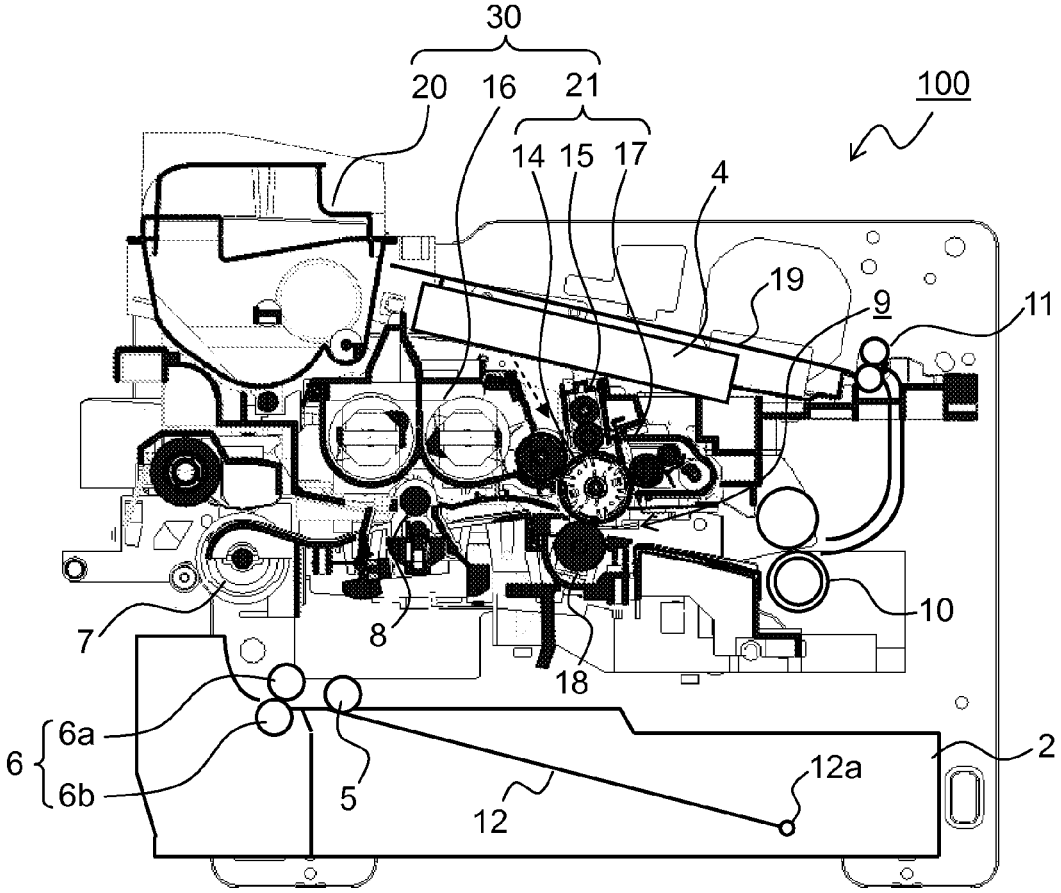
FIG. 1 is a schematic sectional view showing an internal structure of an image forming apparatus according an embodiment of the present disclosure.
Figure 2:
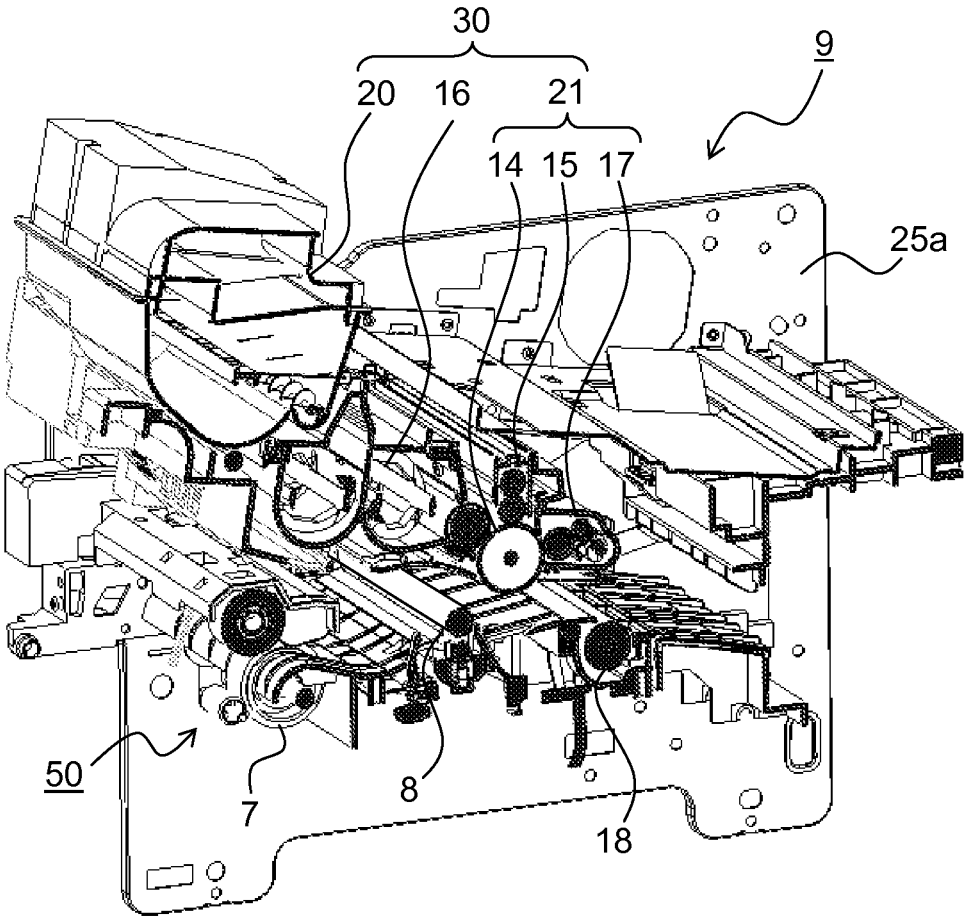
FIG. 2 is a sectional perspective view of an image forming portion 9 of an image forming apparatus 100 in FIG. 1.

Hereinafter, an embodiment of the present disclosure is described with reference to the drawings. FIG. 1 is a schematic sectional view of an image forming apparatus according an embodiment of the present disclosure, and FIG. 2 is a sectional perspective view of an image forming portion 9 of the image forming apparatus. As shown in FIG. 1, an image forming apparatus 100 (here, a monochrome printer) is provided with a paper-sheet supply cassette 2 that stores paper sheets stacked in an apparatus main body lower portion. Over this paper-sheet supply cassette 2, a paper-sheet carry route is formed, which extends substantially horizontally from an apparatus main body front side to an apparatus main body rear side, further extends upward to lead to an ejection tray 19 that is formed on an apparatus main body upper surface, and successively from an upstream along this paper-sheet carry route, a pick-up roller 5, a pair of paper-sheet supply rollers 6, an intermediate carry roller 7, a pair of resist rollers 8, an image forming portion 9, a fix portion 10, and a pair of ejection rollers 11 are disposed. Further, in the image forming apparatus 100, a control portion (not shown), which controls operation of the above rollers, the image forming portion 9, the fix portion 10 and the like, is disposed.

The paper-sheet supply cassette 2 is provided with a paper-sheet stack plate 12 that is supported rotatably with respect to the paper-sheet supply cassette 2 by a rotation pivot 12*a* that is disposed at a rear end portion in a paper-sheet carry direction, and paper sheets stacked on the paper-sheet stack plate 12 are pushed to the pick-up roller 5. Besides, a structure is employed, in which in front of the paper-sheet supply cassette 2, the pair of paper-sheet supply rollers 6, which include a feed roller 6*a* and a retard roller 6*b* that comes in tight contact with the feed roller 6*a*, are disposed, and in a case where a plurality of paper sheets are supplied at the same time by the pick-up roller 5, the paper sheets are separated by these feed roller 6*a* and the retard roller 6*b*, whereby only the uppermost paper sheet is carried at a time.

And, the paper sheet separated by the feed roller 6*a* and the retard roller 6*b* is changed in carry direction by the intermediate carry roller 7 toward a backward portion of the device to be carried to the pair of resist rollers 8, adjusted in timing by the pair of resist rollers 8 and supplied to the image forming portion 9.

The image forming portion 9 forms a predetermined toner image on a paper sheet by means of an electro-photographic process, is composed of a photosensitive drum 14, that is, an image carrying body supported rotatably counterclockwise by a shaft in FIG. 1, a charge device 15, a development device 16, a cleaning device 17, a transfer roller 18 disposed to oppose the photosensitive drum 14 via the paper sheet carry route 4 that are disposed around the photosensitive drum 14 and an light exposure unit (LSU) 4 disposed above the photosensitive drum 14. And above the development device 16, a toner container 20 for supplying toner to the development device 16 is disposed.

The photosensitive drum 14 collaborates with the charge device 15 and the cleaning device 17 to constitute a drum unit 21. Besides, the drum unit 21 collaborates with the development device 16 and the toner container 20 to constitute an image forming unit 30 that is, as a single body, insertable in and drawable from the image forming apparatus 100 main body. The drum unit 21, the development device 16 and the toner container 20, which constitute the image forming unit 30, are each separable. The intermediate carry roller 7, the pair of resist rollers 8 and the transfer roller 18 are disposed in a carry unit 50 that is disposed under the image forming unit 30. Here, FIG. 2 shows only a portion of the carry unit 50.

The charge device 15 is provided with an electroconductive rubber roller to which a not-shown power supply is connected, and is disposed in such a way that this electroconductive rubber roller contacts the photosensitive drum 14. And, when the photosensitive drum 14 rotates, the electroconductive rubber roller that contacts with a surface of the photosensitive drum 14 is rotated, and at this time, by applying a predetermined voltage to the electroconductive rubber roller, the surface of the photosensitive drum 14 is evenly charged.

Next, an electrostatic latent image is formed on the photosensitive drum 14 based on input image data by a laser beam from the light exposure unit 4, toner is made to adhere to the electrostatic latent image by the development device 16, whereby a toner image is formed on the surface of the photosensitive drum 14. Further, the toner image on the surface of the photosensitive drum 14 is transferred by the transfer roller 18 onto a paper sheet that is supplied to a transfer position which is formed at a nip portion between the photosensitive drum 14 and the transfer roller 18.

The paper sheet, on which the toner image is transferred, is separated from the photosensitive drum 14 and carried to the fix portion 10. This fix portion 10 is disposed in a downstream with respect to the image forming portion 9 in the paper-sheet carry direction, and the paper sheet, onto which the toner image is transferred in the image forming portion 9, is heated and pressurized by a heat roller and a pressure roller pressurized to the heat roller that are disposed in the fix portion 10, whereby the toner image transferred on the paper sheet is fixed.

And, the paper sheet, on which the image is formed in the image forming portion 9 and the fix portion 10, is ejected onto the ejection tray 19 by the pair of ejection rollers 11. On the other hand, after the transfer, toner remaining on the surface of the photosensitive drum 14 is removed by the cleaning device 17, and remaining charges on the surface of the photosensitive drum 14 are removed by an electricity removal device (not shown). And, the photosensitive drum 14 is recharged by the charge device 15, thereafter, images are formed in the same way.

Figure 3:
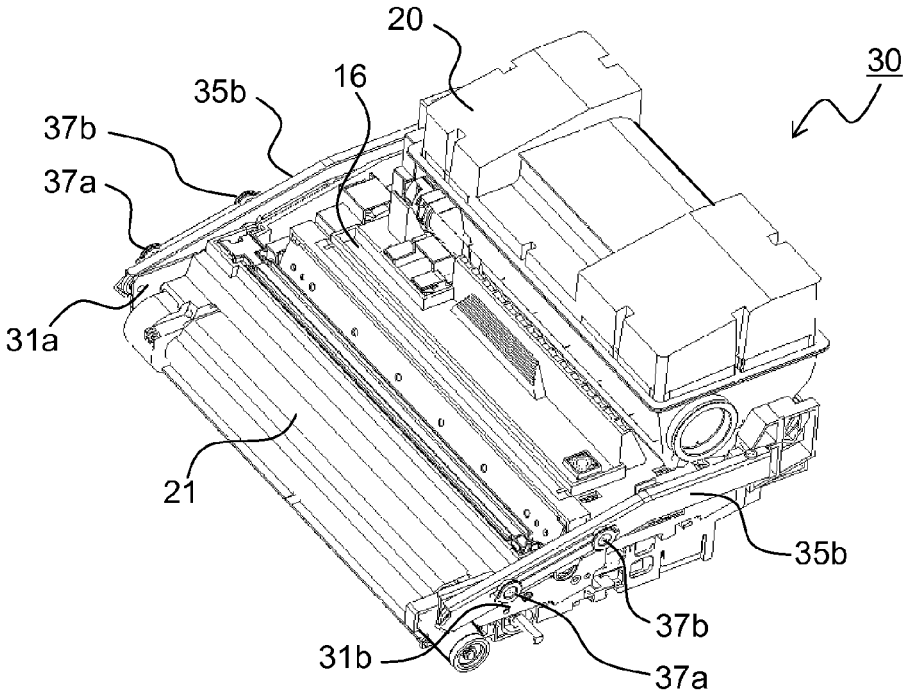
FIG. 3 is a top perspective view when viewing an image forming unit 30 from behind FIG. 1.
Figure 4:
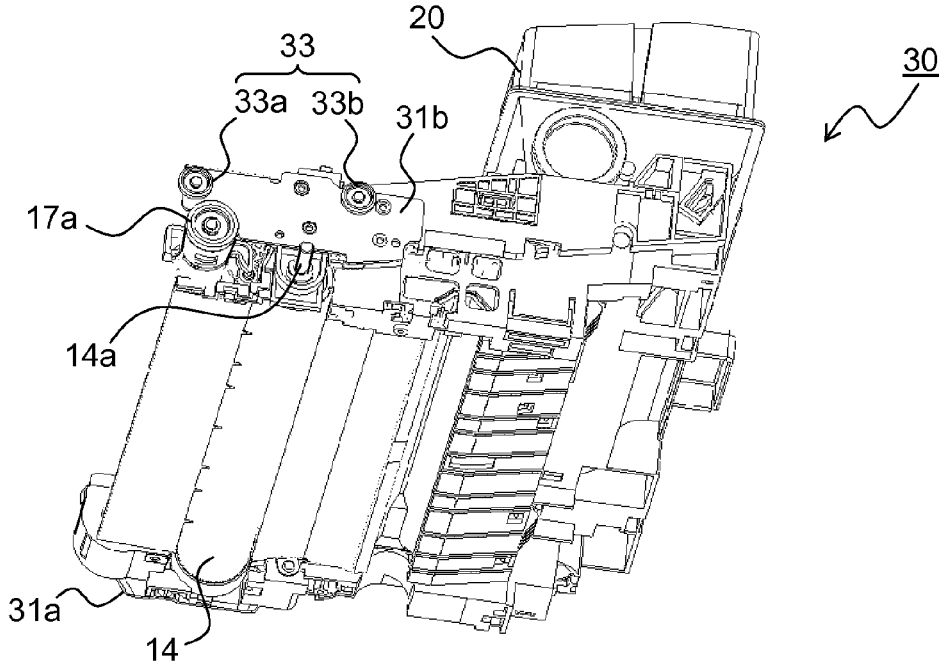
FIG. 4 is a bottom perspective view when viewing the image forming unit 30 from behind FIG. 1.

FIG. 3 and FIG. 4 are perspective views when viewing the image forming unit 30 from an obliquely upper portion and an obliquely lower portion of FIG. 1, respectively. Sheet metal frames 31*a*, 31*b* are fixed to both side surfaces of the drum unit 21 that constitutes the image forming unit 30, and a pair of unit-side rollers 33 are rotatably mounted on each of the sheet metal frames 31*a*, 31*b*.

The unit-side roller 33 includes a first roller 33*a* disposed in a downstream and a second roller 33*b* disposed in an upstream in the unit insertion direction, and moves rotating in a rail groove 41 (see FIG. 8) formed on an inside of a second rail portion 35*b* that constitutes the slide rail 35 (see FIG. 8) disposed on the image forming apparatus 100 main body. Because of this, the drum unit 21 is supported slidably along the second rail portion 35*b*.

Besides, on an outside of the second rail potion 35*b*, two rail-side rollers 37*a* and 37*b*, which move in a slide hole 40 formed through a first rail portion 35*a*, are rotably mounted. In an inner portion (front side of FIG. 4) of the drum unit 21, a rotation shaft 14*a* of the photosensitive drum 14 and a screw bearing 17*a*, into which a rotation shaft of a collection screw for discharging wasted toner in the cleaning device 17 (see FIG. 1) to outside is inserted, protrude. Here, in FIG. 4, the second rail portion 35*b* is not shown.

Figure 5:
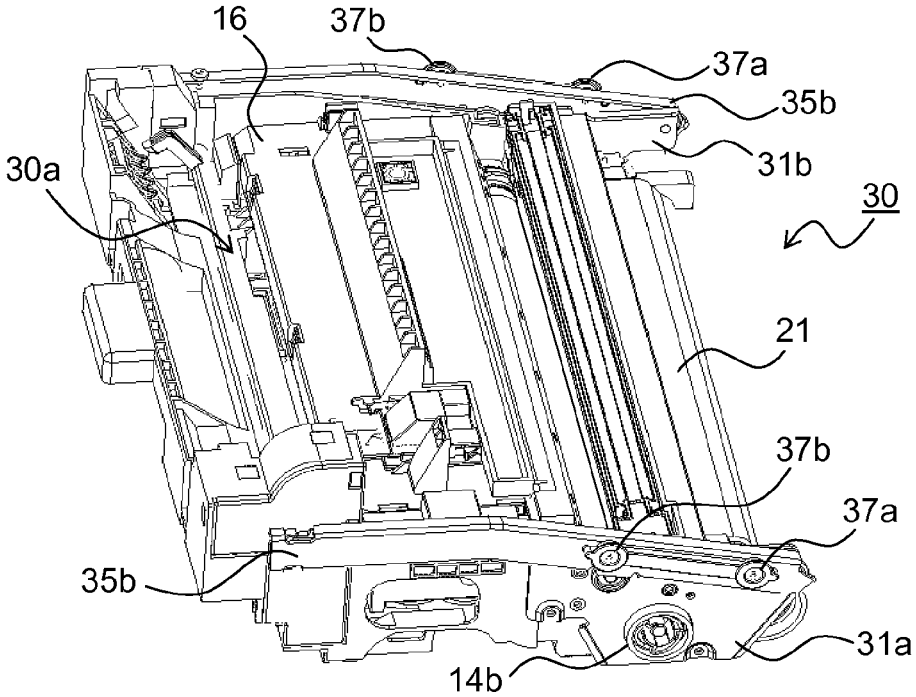
FIG. 5 is a perspective view showing a state in which a toner container 20 is demounted from the image forming unit 30.
Figure 6:
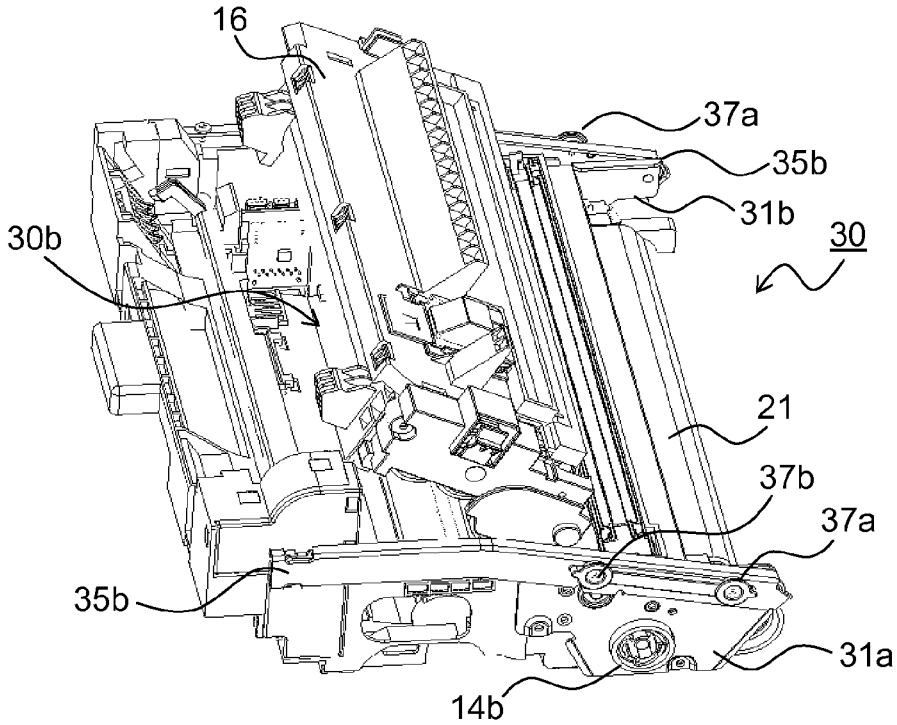
FIG. 6 is a perspective view showing a state in which further a development device 16 is being demounted from the state in FIG. 5.
Figure 7:
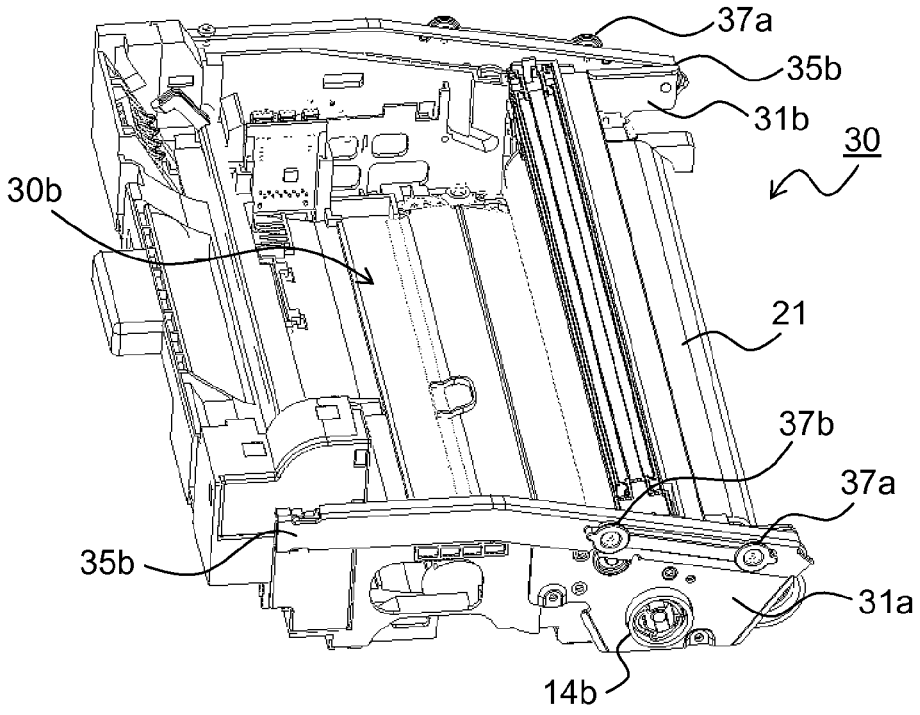
FIG. 7 is a perspective view of the image forming unit 30 with the toner container 20 and the development device 16 demounted.

FIG. 5 is a perspective view showing a state in which the toner container 20 is demounted from the image forming unit 30, FIG. 6 is a perspective view showing a state in which further the development device 16 is being demounted from the state in FIG. 5, and FIG. 7 is a perspective view of the image forming unit 30 with the toner container 20 and the development device 16 demounted. Here, FIG. 5 to FIG. 7 show a state in which the image forming unit 30 is viewed from a front side of FIG. 1, and the directions of the image forming unit 30 are reverse to each other in FIG. 3 and FIG. 4.

By lifting an upstream end portion of the toner container 20 in the unit insertion direction from the state in FIG. 3 and FIG. 4, as shown in FIG. 5, the toner container 20 is demounted from a first housing portion 30*a* of the image forming unit 30. Further, as shown in FIG. 6, by holding and lifting an upstream end portion (left end portion of FIG. 6) of the development device 16 in the unit insertion direction, as shown in FIG. 7, the development device 16 is demounted from a second housing portion 30*b* of the image forming unit 30. In a front side (front side of FIG. 5) of the drum unit 21, a drum bearing 14*b*, into which the rotation shaft 14*a* of the photosensitive drum 14 is inserted, protrudes.

Figure 8:
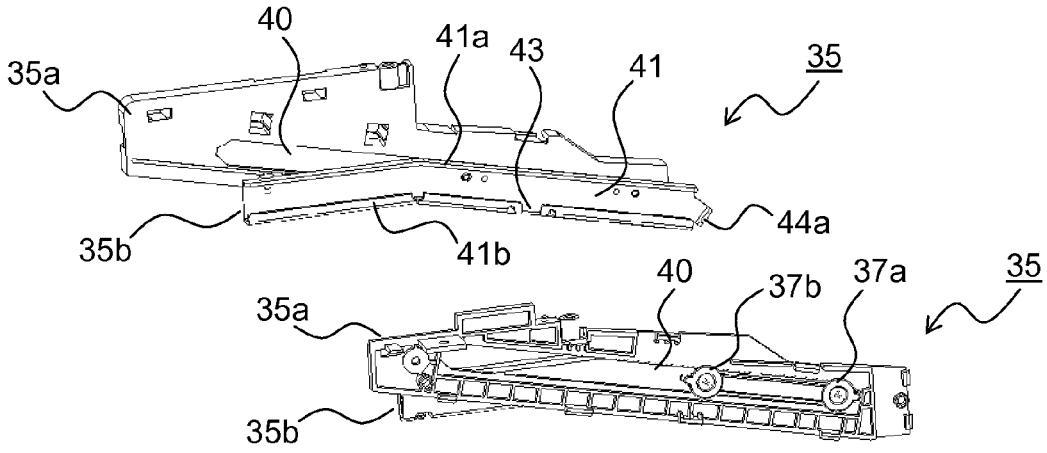
FIG. 8 is a perspective view of a slide rail 35 that slidably supports the image forming unit 30, that is, a view showing a state in which a second rail portion 35*b* is situated at a position to be housed in a first rail portion 35*a*.
Figure 9:
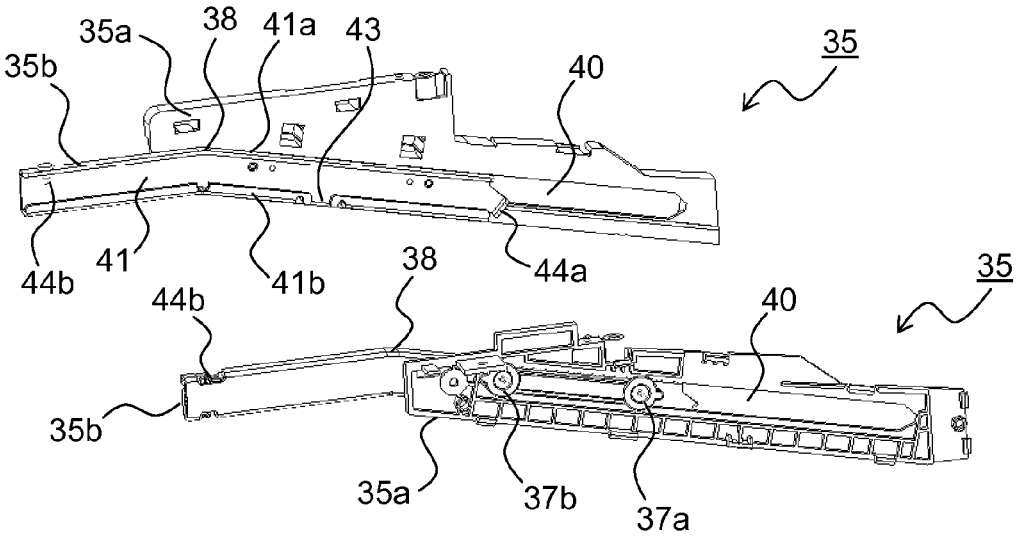
FIG. 9 is a perspective view of the slide rail 35 that slidably supports the image forming unit 30, that is, a view showing a state in which the second rail portion 35*b* is situated at a position to be drawn out from the first rail portion 35*a*.

FIG. 8 and FIG. 9 are each a perspective view of the slide rail 35 that slidably supports the image forming unit 30. The slide rail 35 is composed of the first rail portion 35*a* and the second rail portion 35*b*, and the first rail portion 35*a* is fixed to a side frame 25*a* (see FIG. 2) of the image forming apparatus 100 main body. The first rail portion 35*a* is provided with the slide hole 40, while on the outside of the second rail portion 35*b*, the rail-side rollers 37*a* and 37*b*, which slidably engage the slide groove 40, are disposed. The rail-side rollers 37*a*, 37*b* move in the slide hole 40, whereby the second rail portion 35*b* is selectively disposed at a position to be housed in the first rail portion 35*a* as shown in FIG. 8 and a position to be drawn out from the first rail portion 35*a* as shown in FIG. 9.

A shape of the second rail portion 35*b* is a dogleg shape when viewed from side that has a bent portion 38. On the inside of the second rail portion 35*b*, the rail groove 41, which is interposed between an upper rail 41*a* and a lower rail 41*b* with which the unit-side rollers 33*a*, 33*b* of the image forming unit 30 rotatably engage respectively, is formed. A portion of the lower rail 41*b* is provided with a cut-away portion 43 which is larger than diameters of the unit-side rollers 33*a* and 33*b*.

Besides, a downstream end portion (right end portion in FIG. 9) of the second rail potion 35*b* in the unit insertion direction is provided with a first run-off prevention portion 44*a* that prevents the unit-side roller 33*a* from running off the rail groove 41. On the other hand, an upstream end portion (left end portion in FIG. 9) of the second rail portion 35*b* is provided with a second run-off prevention portion 44*b* that prevents the unit-side roller 33*b* from running off the rail groove 41. Specifically, the second rail portion 35*b* in an inner portion of the device is provided with the second run-off prevention portion 44*b* by means of a screw that is turned and fitted in the upper rail 41*a*. And, the second rail portion 35*b* in a front portion of the device is provided with the second run-off prevention portion 44*b* by means of a resin snap-fit that is inserted in the rail groove 41.

Figure 10:
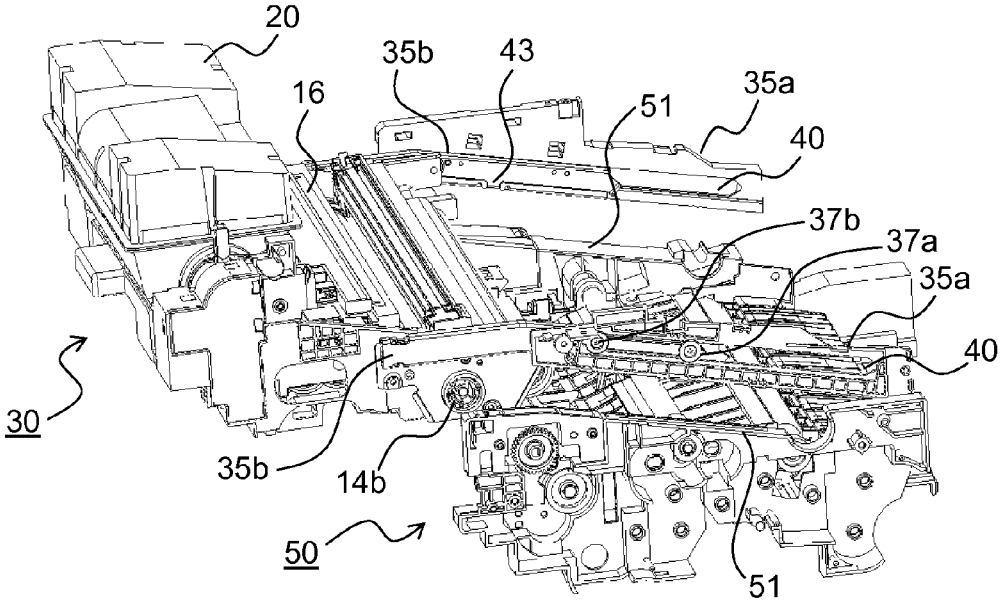
FIG. 10 is a perspective view showing a state in which the image forming unit 30 is drawn out to the full from a carry unit 50.

Next, operations of the insertion in and drawing out from the image forming unit 30 of the image forming apparatus 100 main boy are described. FIG. 10 is a perspective view showing a state in which the image forming unit 30 is drawn out from the image forming apparatus 100 main body, and FIG. 11 is a perspective view showing a relationship between the sheet metal frames 31*a*, 31*b* and the second rail portion 35*b* in FIG. 10.

As shown in FIG. 10, the pair of slide rails 35, which are inclined downward toward a downstream side in the insertion direction, are fixed to the side frame 25*a* (see FIG. 2) of the image forming apparatus 100 main body. A pair of support portions 51, which extend substantially in parallel with the slide rails 35 below the slide rails 35, are formed on the carry unit 50 that is fixed to the image forming apparatus 100 main body. The image forming unit 30 is slidably supported on the image forming apparatus 100 main body by the slide rails 35 and the support portions 51. Specifically, in the front portion of the apparatus, the drum bearing 14*b* contacts the uppermost portion of one of the support portions 51. Besides, although not shown, in the inner portion of the apparatus, the screw bearing 17*a* (see FIG. 4) contacts the uppermost portion of the other of the support portions 51. The rail-side roller 37*b* disposed in the second rail portion 35*b* moves to be situated at an upstream end portion (left end in FIG. 10) of the slide hole 40 formed through the first rail portion 35*a*.

Figure 11:
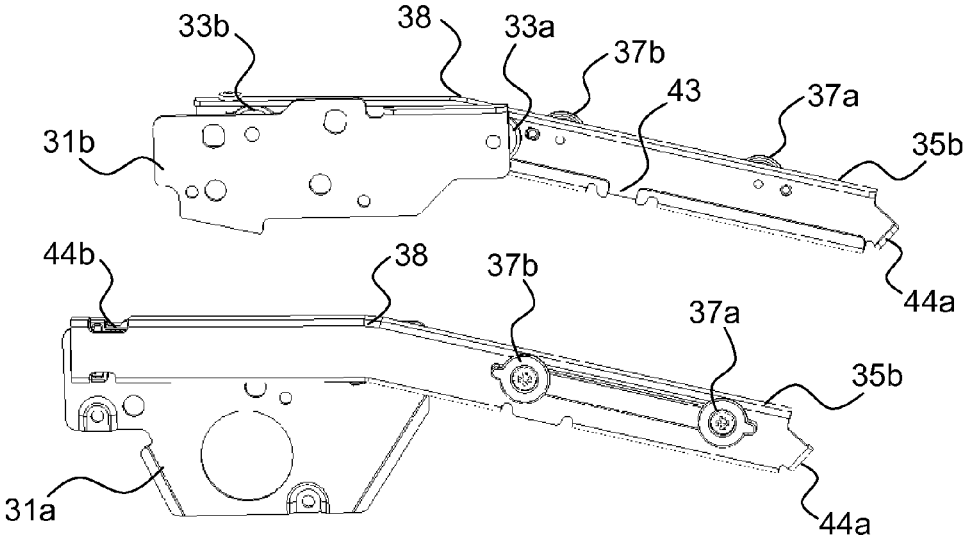
FIG. 11 is a perspective view showing a positional relationship between the slide rail 35 and sheet metal frames 31*a*, 31*b* of the image forming unit 30 in FIG. 10.

Further, as shown in FIG. 11, the sheet metal frames 31*a* and 31*b* fixed to the image forming unit 30 move to be situated at the upstream end portion (left end in FIG. 11) of the second rail portion 35*b* in the unit insertion direction. In other words, FIG. 10 shows a state in which the image forming unit 30 is drawn out to the full from the image forming apparatus 100 main body.

In this state, an upper side of the carry unit 50 is widely opened, so that it is possible to easily remove a jammed paper sheet. Besides, as shown in FIG. 5 to FIG. 7, by demounting the toner container 20 and the development device 16, it becomes possible to perform replacement and maintenance of the toner container 20 and the development device 16. Besides, the upstream end portion of the second rail portion 35*b* in the unit insertion direction is provided with the second run-off prevention portion 44*b*, so that there is no risk that the unit-side roller 33 runs off from the rail groove 41 of the second rail portion 35*b* and the image forming unit 30 comes off from the image forming apparatus 100 main body. Besides, the image forming unit 30 is not completely separated from the image forming apparatus 100 main body, so that a place for leaving the demounted image forming unit 30 becomes unnecessary and there is no risk that when mounting the image forming unit 30, foreign matter adheres to the image forming unit 30 and brought into the image forming apparatus 100 main body.

Further, the second rail portion 35*b* is bent in the dogleg shape when viewed from side and supported by the first rail portion 35*a* in such a way that the upstream side in the insertion direction becomes substantially horizontal, so that the image forming unit 30 is held substantially horizontally with drawn out from the image forming apparatus 100 main body. Accordingly, the height of the image forming unit 30 in a drawn out state is curbed, so that it is possible to widen a view field for an operator during a jam resolving time and a maintenance time. Besides, it is possible to stably hold the image forming unit 30 drawn out from the image forming apparatus 100 main body.

Figure 12:
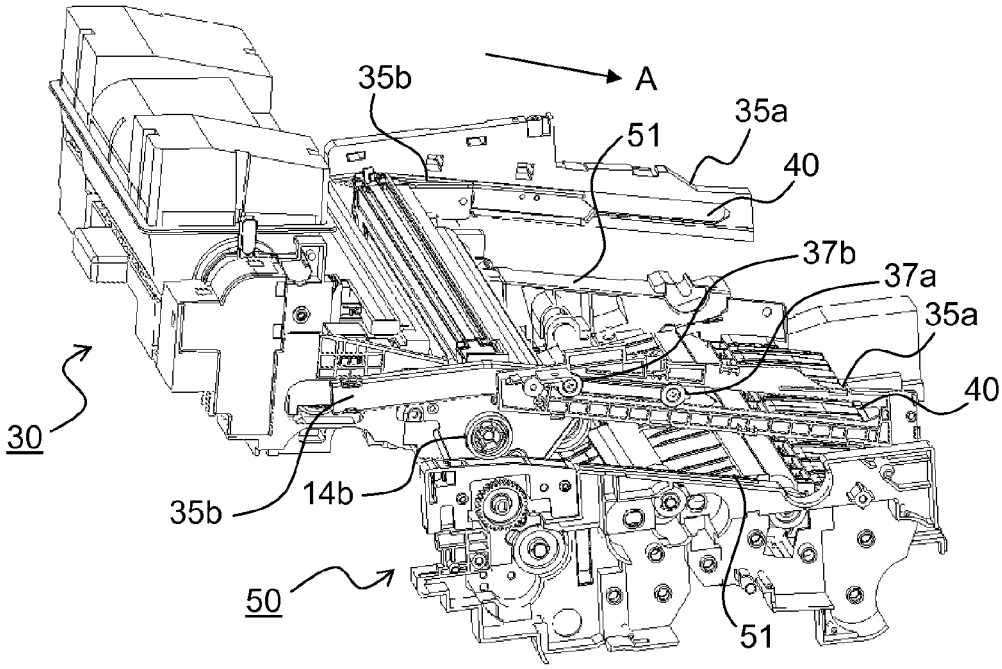
FIG. 12 is a perspective view showing a state in which the image forming unit 30 is pushed into the carry unit 50 by a predetermined amount from the state in FIG. 10.
Figure 13:
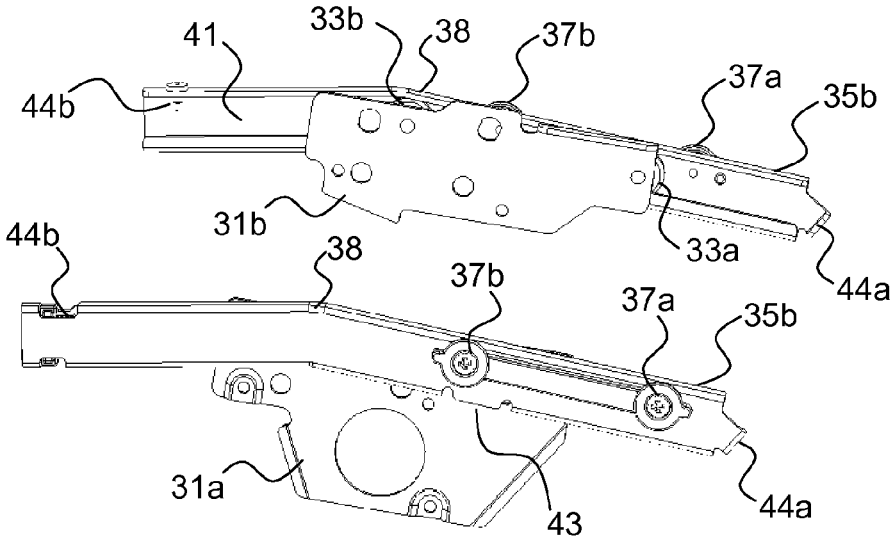
FIG. 13 is a perspective view showing a positional relationship between the slide rail 35 and the sheet metal frames 31*a*, 31*b* of the image forming unit 30 in FIG. 12.

As shown in FIG. 12, when the image forming unit 30 is slid in an arrow A direction from the state in FIG. 10 into the image forming apparatus 100 main body, the unit-side roller 33 (first roller 33*a*, second roller 33*b*) rolls in the rail groove 41 of the second rail portion 35*b* to move in the insertion direction (arrow A direction). Because of this, as shown in FIG. 13, the sheet metal frames 31*a* and 31*b* move to a position near the bent portion 38 of the second rail portion 35*b*

Figure 14:
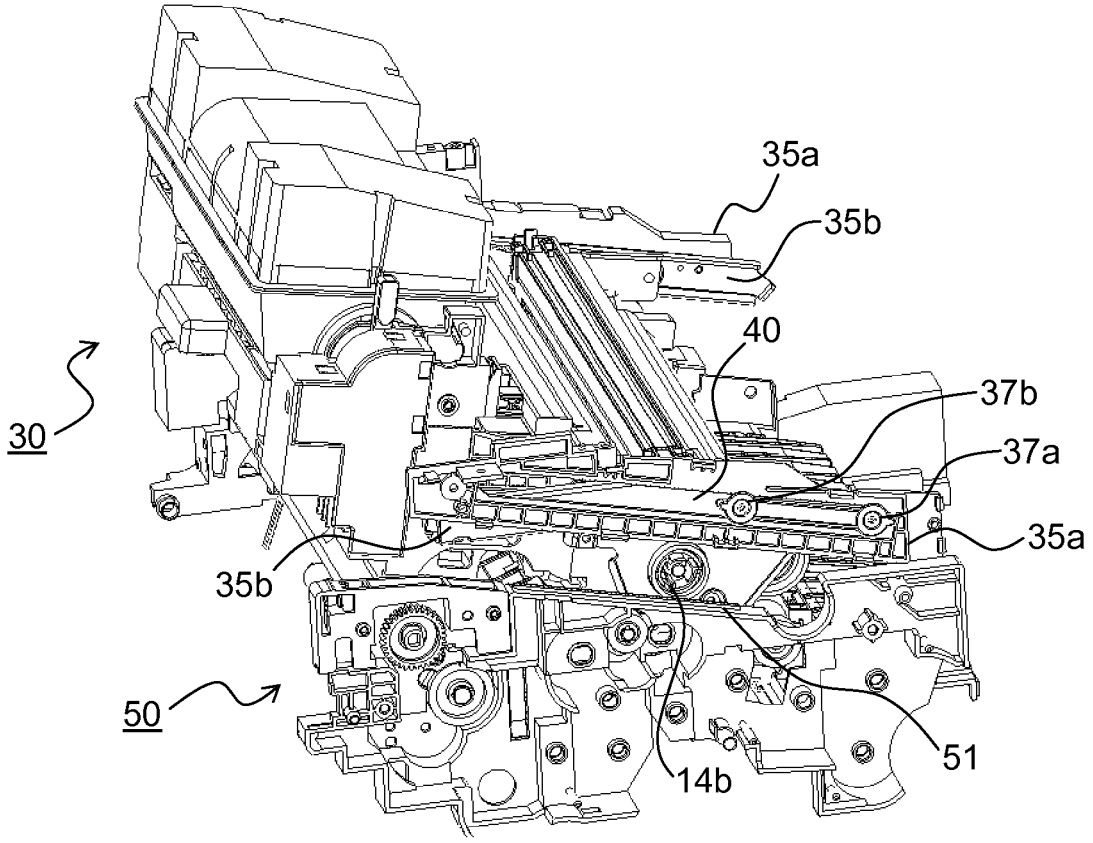
FIG. 14 is a perspective view showing a state in which the image forming unit 30 is pushed into the carry unit 50 by a predetermined amount from the state in FIG. 12.

Besides, the rail-side rollers 37*a* and 37*b* of the second rail portion 35*b* move in the insertion direction in the slide hole 40 of the first rail portion 35*a*. As a result of this, as the image forming unit 30 is inserted, the second rail portion 35*b* is housed to overlap the first rail portion 35*a*, and as shown in FIG. 14, the image forming unit 30 also is inserted into the inside of the image forming apparatus 100.

Figure 15:
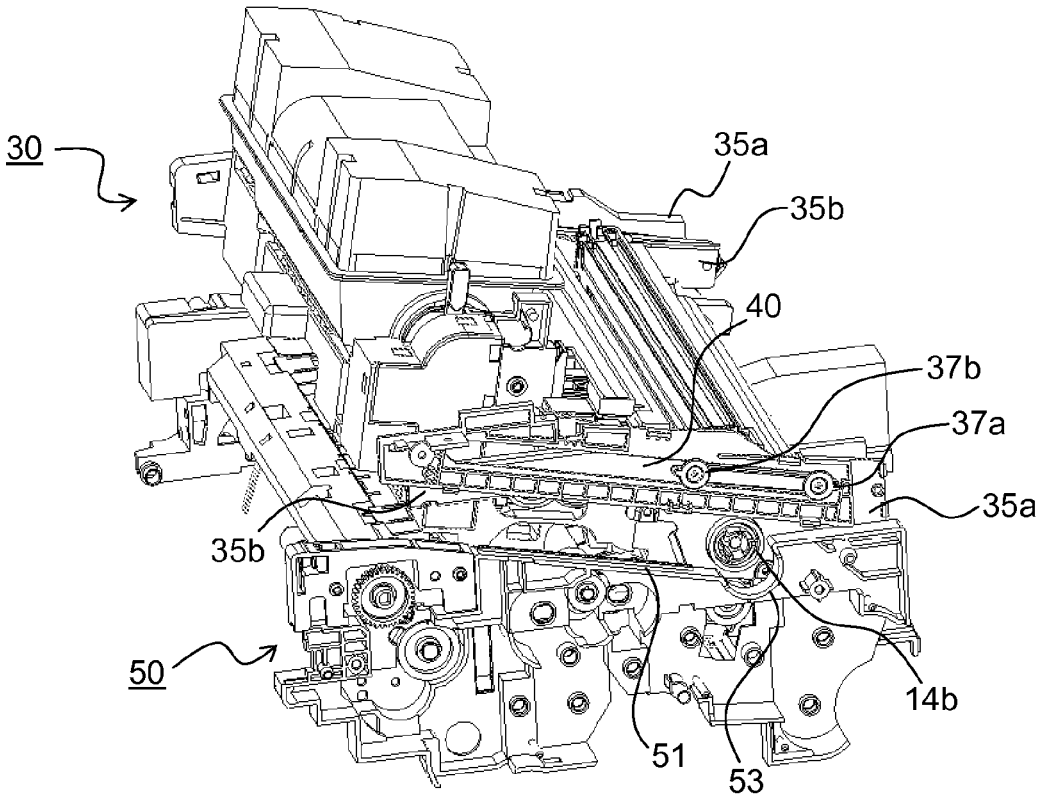
FIG. 15 is a perspective view showing a state in which the image forming unit 30 is pushed into the carry unit 50 by a predetermined amount from the state in FIG. 14.
Figure 16:
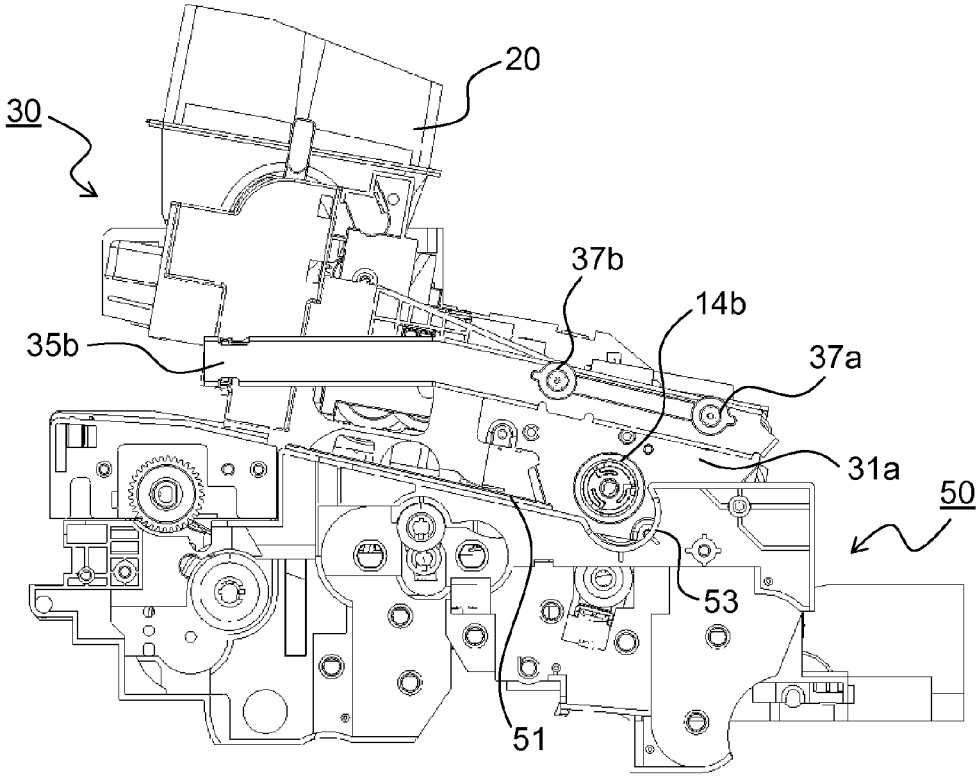
FIG. 16 is a side view showing a state in which the image forming unit 30 is pushed into the carry unit 50 by a predetermined amount from the state in FIG. 14.
Figure 17:
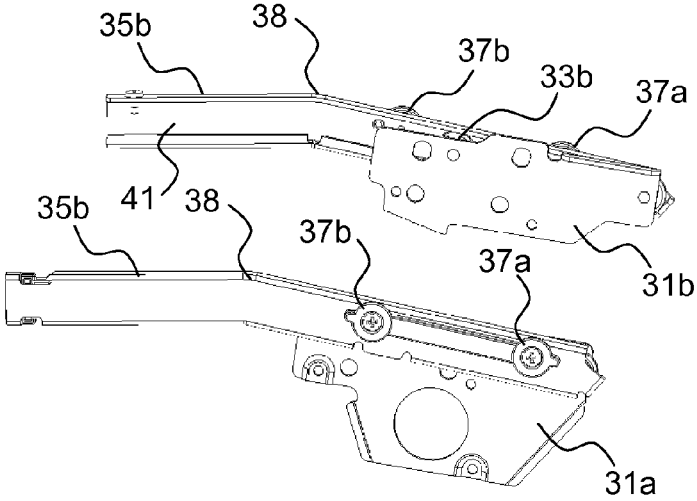
FIG. 17 is a perspective view showing a positional relationship between the slide rail 35 and the sheet metal frames 31*a*, 31*b* of the image forming unit 30 in FIG. 15 and FIG. 16.

When the image forming unit 30 is further inserted in the arrow A direction, as shown in FIG. 15 and FIG. 16, the image forming unit 30 is further inserted into the image forming apparatus 100. At this time, as shown in FIG. 17, the first roller 33*a* of the unit-side roller 33 goes beyond the bent portion 38 and the cut-away portion 43 and moves in the rail groove 41 of the second rail portion 35*b* to the insertion end portion. When the first roller 33*a* passes the cut-away portion 43, the drum bearing 14*b* and the screw bearing 17*a* of the image forming unit 30 are supported by the support portion 51, so that the first roller 33*a* does not run off from the cut-away portion 43.

Figure 18:
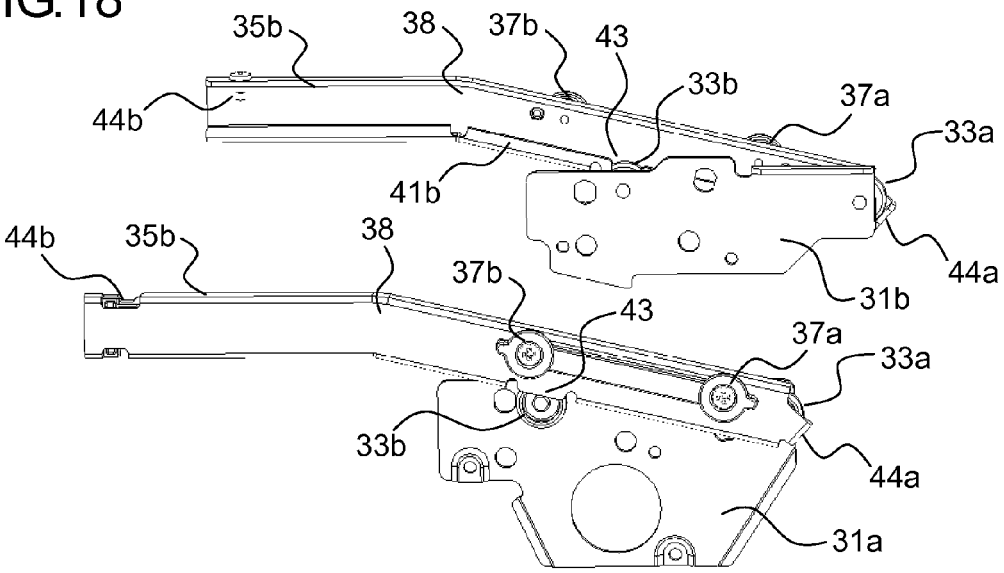
FIG. 18 is a perspective view showing a state in which a second roller 33*b* runs off via a cut-away portion 43 of the second rail portion 35*b*.

Thereafter, as shown in FIG. 18, when the second roller 33*b* reaches the cut-away portion 43 of the lower rail 41*b*, the drum bearing 14*b* falls in a positioning hole 53 that is formed at the downstream end portion of the support portion 51 in the insertion direction. Besides, although not shown, the screw bearing 17*b* also falls in a positioning hole that is formed at the downstream end portion of the support portion 51. As a result of this, the second roller 33*b* runs off downward from the cut-away portion 43.

Figure 19:
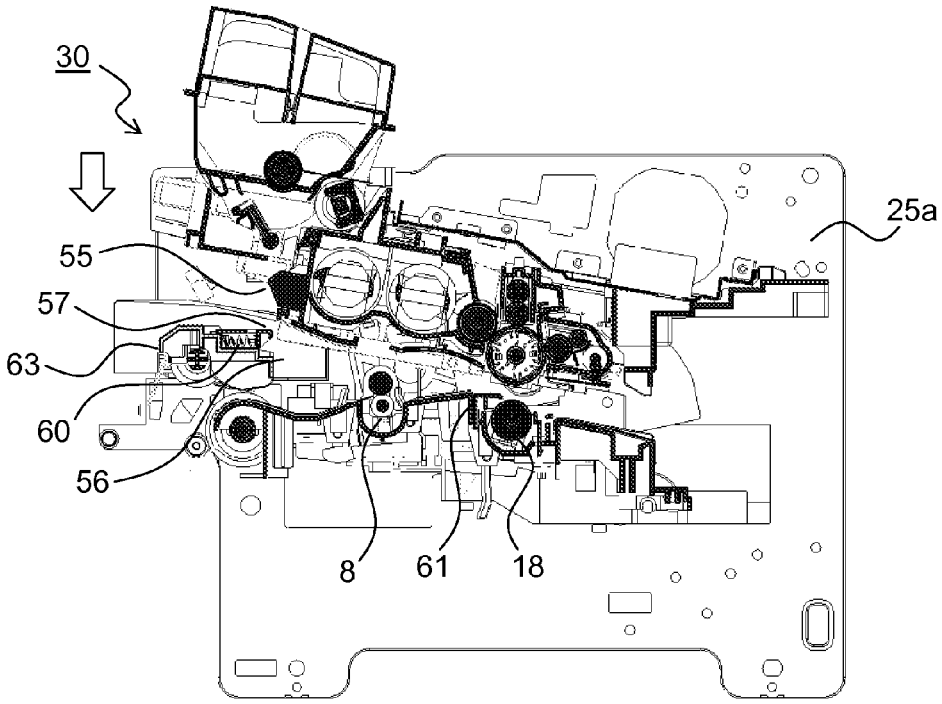
FIG. 19 is a side sectional view of the image forming unit 30 and the carry unit 50 in a state in which the second roller 33*b* runs off.

Because of this, the image forming unit 30 also is inclined downward by a predetermined amount, and as shown in FIG. 19, the photosensitive drum 14 comes close from above the transfer roller 18. Here, the first run-off prevention portion 44*a* is formed at the downstream end portion of the second rail portion 35*b* in the insertion direction, so that there is no risk that the first roller 33*a* runs off from the rail groove 41 of the second rail portion 35*b* and the image forming unit 30 falls into the image forming apparatus 100 main body.

The carry unit 50 is provided with an engagement concave portion 56 into which an engagement protrusion 55, which protrudes to a position behind the development device 16, fits. A lock member 57 is supported on a side surface of the engagement concave portion 56 to protrude out and go in, and the lock member 57 is biased in the protrusion direction by a coiled spring 60. By pushing down the rear end of the image forming unit 30 downward (white arrow direction in FIG. 19), the engagement protrusion 55 pushes and fits the lock member 57 into the engagement concave portion 56 countering the bias force of the coiled spring 60.

Figure 20:
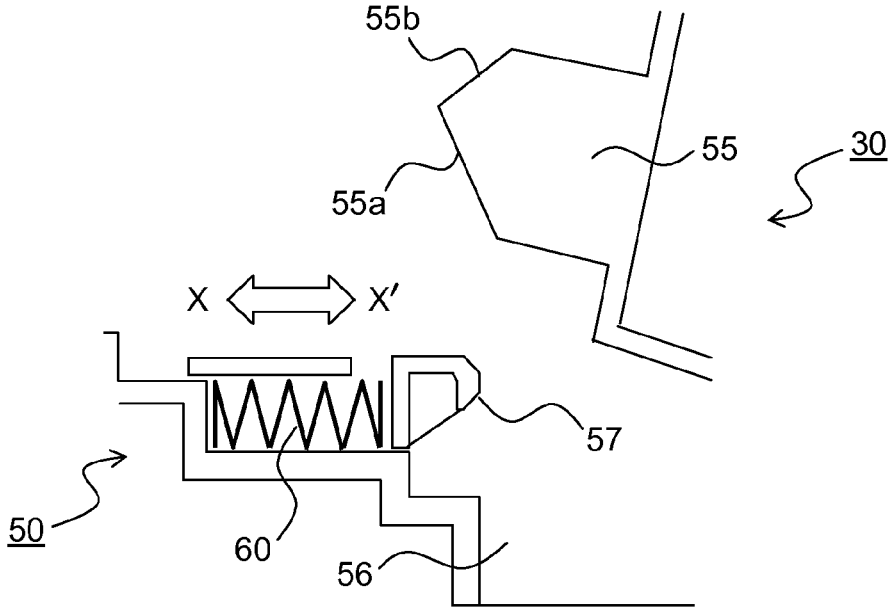
FIG. 20 is a partially enlarged view of a peripheral portion of an engagement protrusion 55 and a lock member 57 in FIG. 19.

FIG. 20 is a partially enlarged view of a peripheral portion of the engagement protrusion 55 and the lock member 57 in FIG. 19. As shown in FIG. 20, a first inclination surface 55*a* is formed on a lower corner portion of the engagement protrusion 55, while a second inclination surface 55*b* is formed on an upper corner portion of the engagement protrusion 55.

Figure 21:
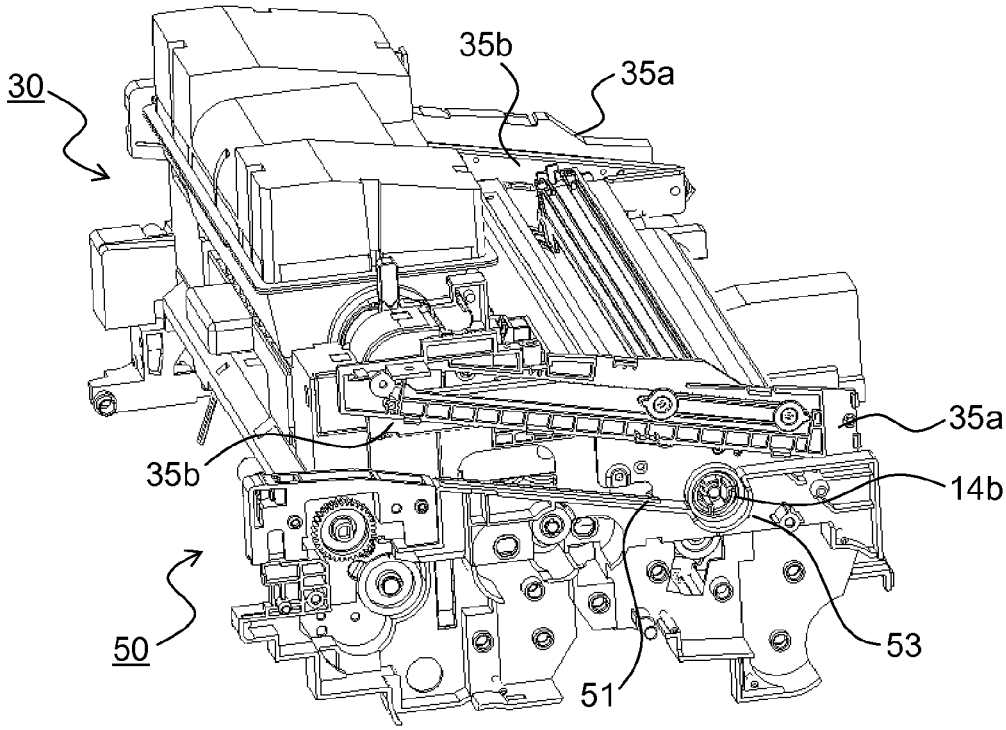
FIG. 21 is a perspective view showing a state in which the image forming unit 30 is pushed into a predetermined position of the carry unit 50.
Figure 22:
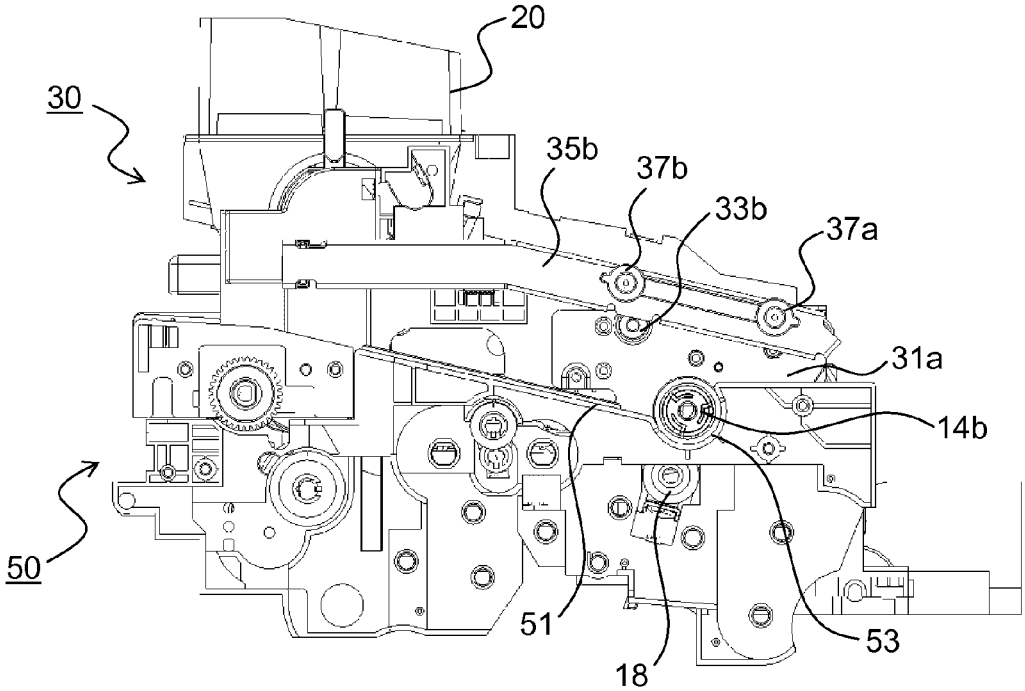
FIG. 22 is a side view showing a state in which the image forming unit 30 is pushed into a predetermined position of the carry unit 50.

When the image forming unit 30 is pushed downward, the engagement protrusion 55 comes close to the lock member 57 from above, and an upper end portion of the lock member 57 comes into contact with the first inclination surface 55*a*. Because of this, force is exerted onto the lock member 57 in an arrow X direction, so that the lock member 57 moves in the arrow X direction countering the bias force of the coiled spring 60. Thereafter, when the first inclination surface 55*a* passes before the lock member 57, the lock member 57 protrudes again in an arrow X' direction by means of the bias force of the coiled spring 60 to engage the second inclination surface 55*b*. Because of this, as shown in FIG. 21 and FIG. 22, the photosensitive drum 14 is placed in a predetermined position to oppose the transfer roller 18.

Figure 23:
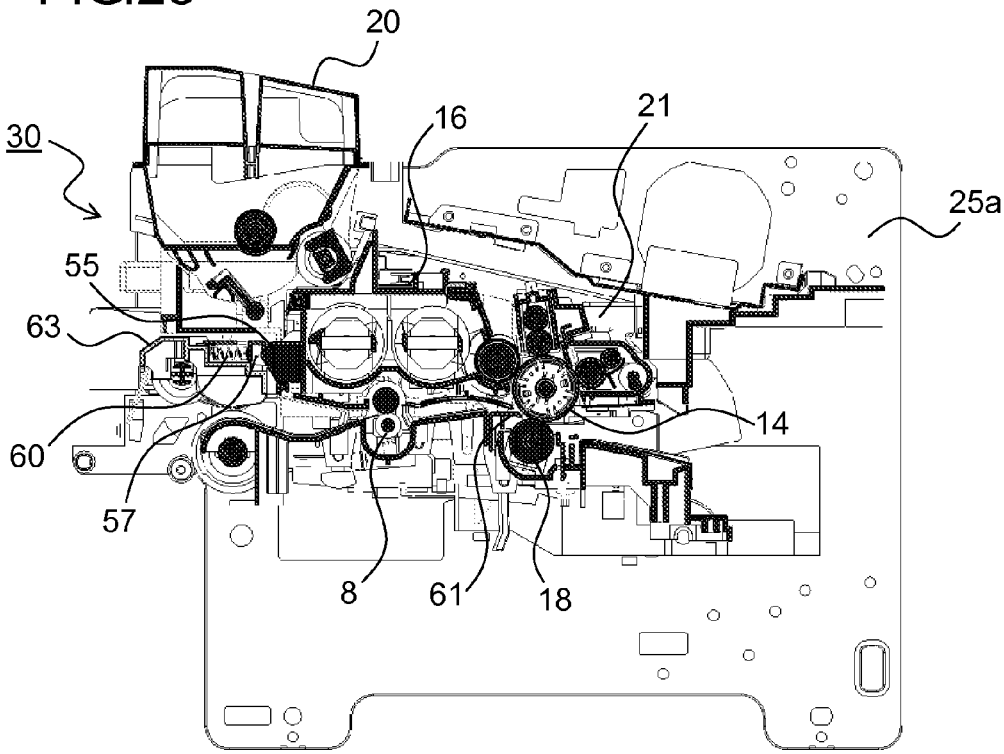
FIG. 23 is a side sectional view showing a state in which the image forming unit 30 is pushed into a predetermined position of the carry unit 50.

Besides, as shown in FIG. 23, the engagement protrusion 55 is pushed by the lock member 57, so that the image forming unit 30 is surely fixed to the carry unit 50. At this time, the development device 16 is biased toward the photosensitive drum 14 by the lock member 57 (right direction in FIG. 23), so that the development device 16 is placed with high accuracy in a predetermined position with respect to the photosensitive drum 14. In other words, the coiled spring 60 biases the development device 16, that is, one of the sub-units, in the predetermined direction, whereby the positioning of the development device 16 (sub-unit) with respect to the image forming unit 30 also becomes possible.

In a case where the image forming unit 30 is drawn out from the image forming apparatus 100 main body, the rear end portion (left end of FIG. 23) of the image forming unit 30 in the insertion direction is held and lifted. Because of this, the second inclination surface 55*b* formed on the upper corner portion of the engagement protrusion 55 comes into contact with the lower end portion of the lock member 57 and the arrow X-direction force is exerted onto the lock member 57, so that the lock member 57 moves in the arrow X direction countering the bias force of the coiled spring 60. When the image forming unit 30 is further lifted, the engagement between the engagement protrusion 55 and the lock member 57 is released, whereby the second roller 33*b* is inserted into the rail groove 41 from the cut-away portion 43 of the second rail portion 35*b*.

In this state, by drawing out the image forming unit 30, the unit-side rollers 33*a* and 33*b* move rolling in the rail groove 41 of the second rail portion 35*b*, the rail-side rollers 37*a* and 37*b* of the second rail portion 35*b* slide in the slide hole 40 of the first rail portion 35*a*, and the image forming unit 30 is drawn out to the position shown in FIG. 10.

As described above, according to the structure of the present disclosure, by making the second roller 33*b* run off from the cut-away portion 43 of the second rail portion 35*b*, it is possible to make the photosensitive drum 14 come close to the transfer roller 18 from right over. Accordingly, it is possible to smoothly mount and demount the image forming unit 30 along the slide rail 35 avoiding contact with obstacles such as the pair of resist rollers 8, a before-transfer guide 61, a roller hold portion 63 (see FIG. 23) for manual paper-sheet supply and the like which are present below the mount-demount routes of the image forming unit 30, and the photosensitive drum 14.

Besides, by disposing, on the image forming apparatus 100 main body, the support portion 51 that supports the image forming unit 30, it is possible to prevent the first roller 33*a* in the downstream in the insertion direction from running off when passing the cut-away portion 43 and surely make only the second roller 33*b* in the upstream in the insertion direction run off.

Besides, by fixing the image forming unit 30 to the carry unit 50 by means of the engagement between the engagement protrusion 55 and the lock member 57, it is possible to place the image forming unit 30 in the predetermined position with high accuracy. At this, time, the development device 16 is pushed toward the photosensitive drum 14 by the bias force of the coiled spring 60 that biases the lock member 57, so that it is also possible to easily and surely perform the positioning of the photosensitive drum 14 and the development device 16. Here, in the above embodiment, the first inclination surface 55*a* and the second inclination surface 55*b* are formed on the engagement protrusion 55, however, the inclination surface may be formed on the lock member 57.

In other words, by forming the inclination surface on at least one of the portions where the engagement protrusion 55 and the lock member 57 contact each other by the mount-demount operation of the image forming unit 30, the lock member 57 is pushed along the inclination surface to move in a direction to be released from the engagement during the mount-demount time of the image forming unit 30. Because of this, the operator is able to surely lock the image forming unit 30 by only pushing it into the image forming apparatus 100 main body, and able to unlock the image forming unit 30 by only lifting it from the image forming apparatus 100 main body.

Besides, tools such as a screw driver and the like for the mount-demount of the image forming unit 30 are unnecessary, so that easy and quick replacement of the development device 16 and the toner container 20 becomes possible and the maintenance work improves. Further, during a jam resolving time, it is not necessary to demount the development device 16 from the image forming unit 30, so that it is possible to prevent adhering of metal foreign matter such as a clip, a staple and the like due to magnetic force of a development roller of the development device 16.

Besides, the present disclosure is not limited to the above embodiment, and variously modifiable without departing from the spirit of the present disclosure. For example, in the above embodiment, the structure is employed, in which the second roller 33*b* of the unit-side roller 33 in the upstream in the insertion direction is made to run off from the cut-away portion 43 so as to position the image forming unit 30, however, it is also possible to form the cut-away portion 43 near the tip end portion of the lower rail 41*b* of the second rail portion 35*b* in the insertion direction so as to make the first roller 33*a* in the downstream in the insertion direction run off. In this case, by disposing the lock mechanism of the image forming unit 30 in the downstream in the insertion direction and by pushing down the downstream side of the image forming unit 30 after the running off of the first roller 33*a*, it is possible to place the image forming unit 30 in the predetermined position avoiding the obstacles present below the mount-demount routes of the image forming unit 30.

Or, a structure may be employed, in which the cut-away portion 43 is formed near the tip end portion of the upper rail 41*a* of the second rail portion 35*b* in the insertion direction and by lifting the downstream side of the image forming unit 30 in the insertion direction, the first roller 33*a* in the downstream in the unit insertion direction is made to run off upward. In this case, it is possible to place the image forming unit 30 in the predetermined position avoiding the obstacles present above the mount-demount routes of the image forming unit 30.

In other words, when inserting the image forming unit 30 into the device main body by means of the slide rail 35, either of the first roller 33*a* and the second roller 33*b* of the unit-side roller 33 is made to run off via the cut-away portion 43, whereby the image forming unit 30 is positioned, so that it is possible to avoid contact with the obstacles present above the mount-demount routes during the time the image forming unit 30 is mounted and demounted along the slide rail 35.

Besides, in the above embodiment, the mount-demount mechanism for the image forming unit 30, which is mounted on and demounted form the carry unit 50, is described as an example, however, it goes without saying that the present disclosure is also applicable to a mount-demount mechanism for other units such as the intermediate transfer unit, the fix unit and the like that are mounted and demounted with disposed on the slide rail 35. Further, in the above embodiment, the slide rail 35 has the expandable and contractable structure that includes the first rail portion 35*a* and the second rail portion 35*b*, however, the slide rail 35 may slidably connect three or more rail portions to each other or may be structured by only one rail portion that does not expand nor contract.

Besides, the present disclosure is not limited to the monochrome printer shown in FIG. 1 and is applicable to various image forming apparatuses that include units such as a monochrome copy machine, a digital multi-function machine, a color copy machine, a color printer, a facsimile and the like that are mountable on and demountable from the device main body via a slide rail.

The present disclosure is usable for an insertion and drawing out mechanism for a unit that is mountable on and demountable from an image forming apparatus main body. By using the present disclosure, a mount-demount mechanism is obtained, in which it is possible to perform the insertion and drawing out operations of a target unit avoiding other units and components that are obstacles and to dispose the unit in a predetermined position of the image forming apparatus main body with high accuracy.

What is claimed is:

1. A mount-demount mechanism for a unit comprising:

a unit that is mountable on and demountable from an apparatus main body;

a pair of slide rails that are disposed on the apparatus main body and slidably support both surfaces parallel to a mount-demount direction of the unit;

a unit-side roller a pair of which is disposed on both sides parallel to the unit mount-demount direction of the unit and includes a first roller that is disposed downstream in a unit insertion direction and a second roller that is disposed upstream in the unit insertion direction;

a positioning portion that is formed on both sides of the unit downstream in the unit insertion direction with respect to the first roller;

a guide portion that is formed on the device main body and guides the positioning portion;

a rail groove that is formed on the slide rail and includes a lower rail and an upper rail with which the unit-side roller engages; and a cut-away portion that is formed on a portion of the upper rail or the lower rail and places the unit at a predetermined position in the apparatus main body by making either of the first roller and the second roller run off from the rail groove, wherein when the first roller passes the cut-away portion, the positioning portion is supported by the guide portion and the second roller is supported by the rail groove, so that the first roller is prevented from running off from the cut-away portion, and the second roller reaches the cut-away portion and runs off the rail grove, so that the positioning portion is positioned by a positioning hole that is formed on the guide portion.

2. The mount-demount mechanism for a unit according to claim 1, wherein the slide rail is composed of a plurality of rail portions that include a first rail portion fixed to the apparatus main body and a second rail portion on which the rail groove is formed, and the plurality of rail portions are slidably linked to each other.

3. The mount-demount mechanism for a unit according to claim 1, wherein the slide rail is bent in a dogleg shape when viewed from side and disposed in such a way that an upstream portion thereof becomes substantially parallel to the insertion direction of the unit.

4. The mount-demount mechanism for a unit according to claim 1, wherein the slide rail is provided with a run-off prevention portion that prevents the unit-side roller from running off from both ends of the rail groove.

5. The mount-demount mechanism for a unit according to claim 1, further comprising:

a lock member that is supported movably to a position where the lock member is able to protrude from the apparatus main body to engage an engagement protrusion formed on the unit and to a position where the lock member is housed into the apparatus main body to be released from the engagement with the engagement protrusion; and a bias member that biases the lock member in a direction to make the lock member engage the engagement protrusion, wherein an inclination surface is formed on at least one of portions where the engagement protrusion and the lock member contact each other because of a mount-demount operation of the unit.

6. The mount-demount mechanism for a unit according to claim 5, wherein one or more sub-units are disposed in the unit and the bias member biases at least one of the sub-units in a predetermined direction.

7. An image forming apparatus comprising the mount-demount mechanism for a unit according to claim 1.

8. An image forming apparatus comprising the mount-demount mechanism for a unit according to claim 6, wherein the sub-unit is a development device and is biased in a direction to near an image carrier that is disposed in the unit.

* * * * *